United States Patent [19]

Ohata

[11] Patent Number: 5,010,866

[45] Date of Patent: Apr. 30, 1991

[54] NONLINEAR FEEDBACK CONTROL METHOD AND APPARATUS FOR AN INTERNAL COMBUSTION ENGINE

[75] Inventor: Akira Ohata, Mishima, Japan

[73] Assignee: Toyota Jidosha Kabushiki Kaisha, Japan

[21] Appl. No.: 337,178

[22] Filed: Apr. 12, 1989

[30] Foreign Application Priority Data

Apr. 12, 1988 [JP] Japan ..... 63-89739

[51] Int. Cl.[5] ..... F02D 41/14

[52] U.S. Cl. ..... 123/436; 123/341; 123/352

[58] Field of Search ..... 123/436, 419, 361, 352, 123/350, 341, 340

[56] References Cited

U.S. PATENT DOCUMENTS

| | | | |
|---|---|---|---|
| 4,509,477 | 4/1985 | Takao et al. | 123/436 |
| 4,638,778 | 1/1987 | Kamei et al. | 123/339 |
| 4,785,780 | 11/1988 | Kawai | 123/339 |
| 4,860,707 | 8/1989 | Ohata | 123/339 |

FOREIGN PATENT DOCUMENTS

| | | | |
|---|---|---|---|
| 0185552 | 6/1986 | European Pat. Off. . | |
| 0287932 | 10/1988 | European Pat. Off. . | |
| 3525409 | 2/1986 | Fed. Rep. of Germany . | |
| 57-8316 | 1/1982 | Japan . | |
| 59-120747 | 7/1984 | Japan | 123/436 |
| 59-120751 | 7/1984 | Japan . | |
| 63-71551 | 3/1988 | Japan . | |
| 63-75334 | 4/1988 | Japan . | |
| 63-75336 | 4/1988 | Japan . | |
| 63-75337 | 4/1988 | Japan . | |
| 63-75338 | 4/1988 | Japan . | |
| 63-80044 | 4/1988 | Japan . | |

*Primary Examiner*—Andrew M. Dolinar

[57] ABSTRACT

A nonlinear feedback control method and apparatus for an internal combustion engine in which a model of the engine is formulated, and load torque is estimated as a variable representing the operating state of the engine. Deviations of the engine from the engine model are formulated as disturbances. Other variables which cannot be measured are determined by making experiments and using tables. Based on the estimated load torque, the formulated deviations and other formulated variables, precise feedback control is executed for the engine, which varies in its operating conditions so that the rotation speed of the engine is adjusted to a target rotation speed by controlling a throttle opening. The estimated load torque is a physically significant control quantity which is easy to manipulate, and which can also be used for various controls such as an ignition timing control and a fuel injection control.

12 Claims, 8 Drawing Sheets

NONLINEAR FEEDBACK CONTROL METHOD AND APPARATUS FOR AN INTERNAL COMBUSTION ENGINE

BACKGROUND OF THE INVENTION

The present invention relates to a nonlinear feedback control apparatus for an internal combustion engine and a feedback control method for executing feedback control of the operating state of the engine so that the rotation speed of the engine becomes stable and converges to a target rotation speed.

A proposed prior-art engine control apparatus and method are based on linear control theory. The prior art thus assures the stability and responsiveness of the control. In this prior art a dynamic model of the engine including actuators and sensors is constructed by a linear approximation of the dynamic behavior of the engine. Based on the rotation speed of the model engine, the actual rotation speed of the real engine is controlled. For example, in Japanese Published Unexamined Patent Application No. S59-120751, the model of the engine is constructed using the linear approximation of the engine behavior, and system identification.

This prior-art engine control system has the following problems when the engine is constructed based on the model.

The operating state of the engine includes a warming-up state, states where the load applied to the engine is large or small, states where the rotation speed of the engine is fast or slow, and various other states. These operating states vary widely. Such a complicated behavior of the engine cannot be determined based on the behavior of the engine model.

The actual behavior of the real engine deviates from that of the engine model. When the real engine is controlled based on the engine model, the precision of the control decreases and sufficient control characteristics of the control system cannot be obtained.

To enhance the precision of the control, in another prior art, multiple models of the engine are constructed according to the various operating states of the engine. The model of behavior approximating that of the controlled engine is selected from the multiple models. However, the multiple models make the control system intricate, thus delaying the response of the system. Furthermore, changes in the control system when the selected model changes to another model cannot be predicted. This prior art cannot really work.

Since the engine model is just theoretical, and since variables representing the internal state of the engine are determined based on the engine model, the variables do not coincide with physical control quantities. Consequently, the use of the variables is limited.

SUMMARY OF THE INVENTION

It is a primary object of the present invention to provide a nonlinear feedback control method and apparatus for an internal combustion engine that can effectively and quickly adjust the rotation speed of the engine to the desired value by determining physically-significant variables representing various operating states of the engine, precisely constructing an engine model conforming to the states of the engine, and then executing an optimum feedback control.

To this end, the present invention provides a nonlinear feedback control method and apparatus for an internal combustion engine, the characteristics of which, as shown in FIG. 1, include modeling behavior of the engine and formulating unmeasurable factors as deviations between the engine and the engine model, using simultaneous equations of a motion equation and a mass conservation equation. The motion equation represents fluctuating motion of the engine including load torque. The mass conservation equation represents fluctuations in intake air pressure of the engine for a predetermined time (S1). The load torque is estimated by developing the simultaneous equations to an augmented system (S2). An optimum feedback control is executed based on the measurable operating states of the engine, the formulated deviations, and the estimated load torque (S3).

BRIEF DESCRIPTION OF THE DRAWINGS

The invention may be best understood by referring to the following description of the preferred embodiment and to the drawings in which.

DETAILED DESCRIPTION OF THE PREFERRED EMBODIMENT

A preferred embodiment of the present invention will be described in detail with reference to the accompanying drawings.

Figure 1:
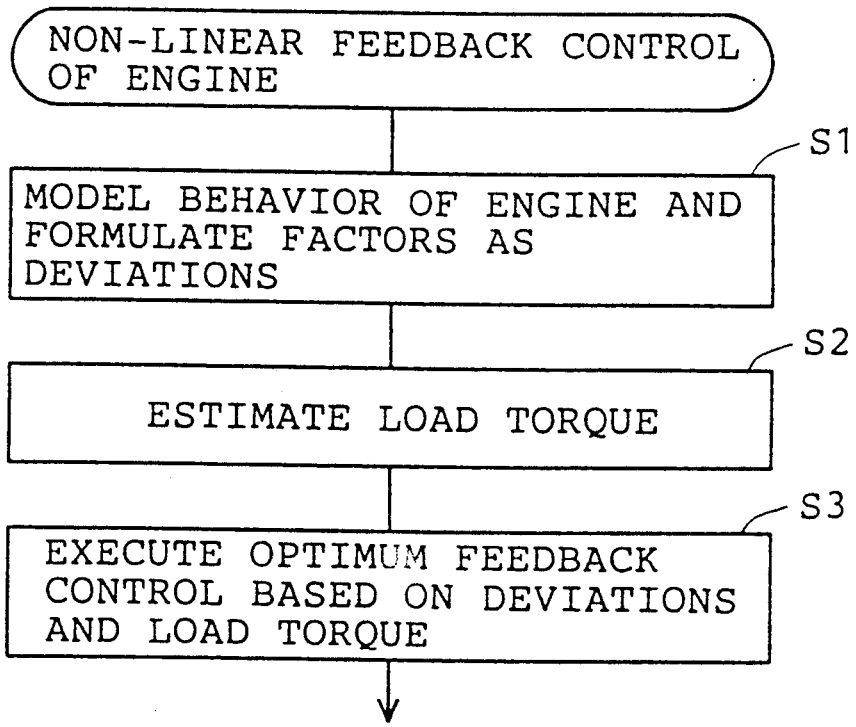
FIG. 1 shows the basic structure of the nonlinear feedback control method for the present invention.
Figure 2:
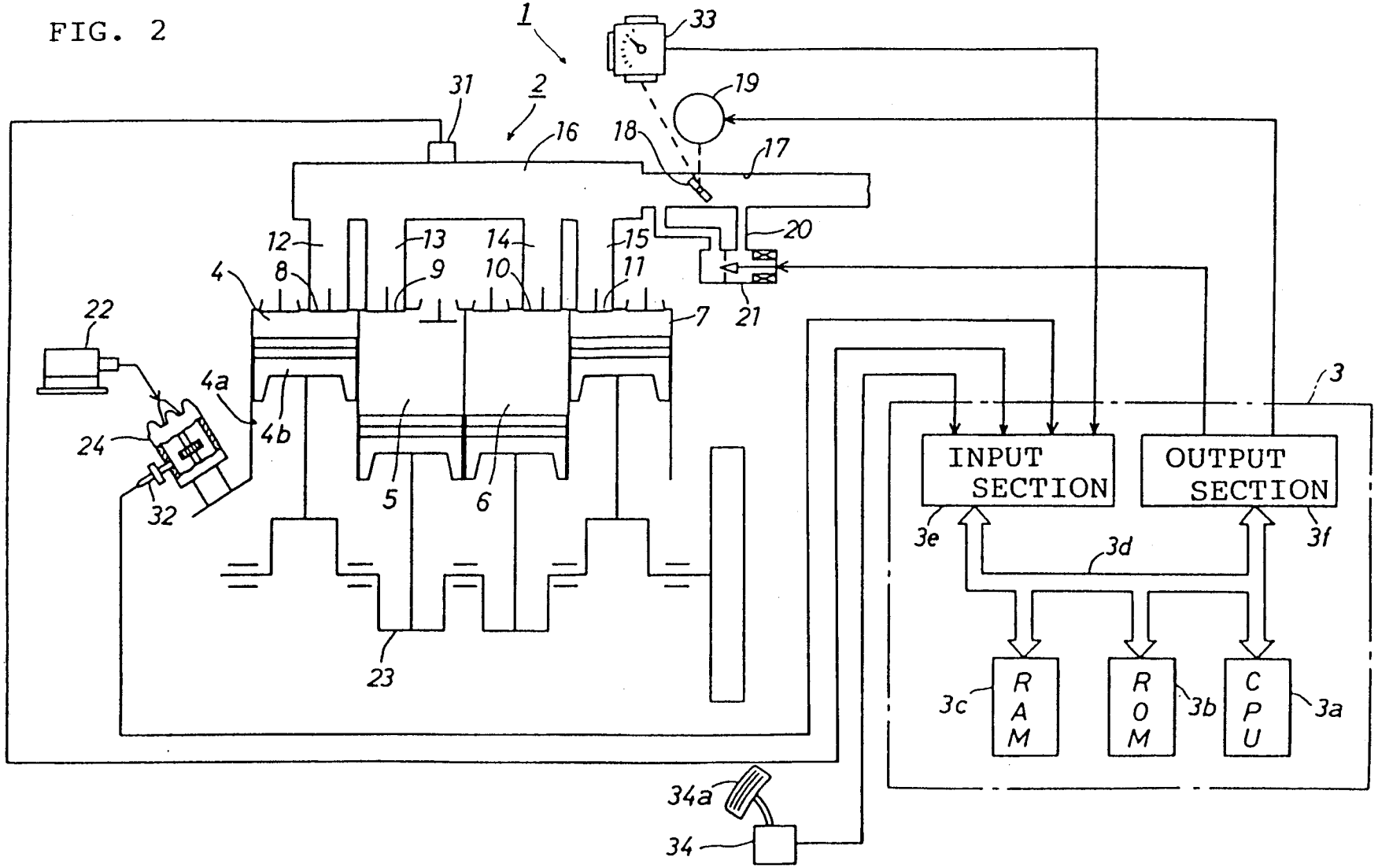
FIG. 2 is a system diagram showing a nonlinear feedback control apparatus of the engine as one an embodiment of the present invention.

As shown in FIG. 2, in this embodiment, an engine controller 1 comprises a four-cylinder engine 2 and an electronic control unit (hereinafter referred to as "ECU") 3 that controls the engine 2.

The engine 2 has a first combustion chamber 4 which comprises a cylinder 4*a* and a piston 4*b*, and second to fourth combustion chambers 5, 6, and 7 with the same arrangement as in the first combustion chamber 4. The combustion chambers 4, 5, 6 and 7 communicate with intake ports 12, 13, 14 and 15 through intake valves 8, 9, 1 0 and 11 , respectively. A surge tank 16, which absorbs pulsation of intake air, is provided at the upstream position of the intake ports 12, 13, 14, and 15. A throttle valve 18 is disposed inside an intake pipe 17 that is provided in the upstream portion of the surge tank 16. The throttle valve 18 is activated by a motor 19. In response to a control signal delivered from the ECU 3, the motor 19 changes the opening of the throttle valve 18 and controls the amount of intake air flowing through the intake pipe 17. The intake pipe 17 has a throttle bypass 20 that passes across the throttle valve 18. An idling speed control valve (hereinafter "ISCV") 21 regulates the throttle bypass 20. The ISCV 21 opens or closes in response to a command signal from the ECU 3, thus adjusting the amount of intake air flowing through the throttle bypass 20.

The engine 2 further comprises an ignition control system 22 equipped with an ignition coil, which generates the high voltage required for ignition, and a distributor 24, which distributes the high voltage generated in the ignition 22 to the respective spark plugs (not shown) of the cylinders in response to the revolution of a crankshaft 23.

The engine controller 1 has the following sensors for detecting various parameters: an intake pressure sensor 31, which is placed on the surge tank 16 to detect a level of intake pressure; a rotation speed sensor 32, which transmits a rotation angle signal every time the camshaft of the distributor 24 rotates by 15° corresponding to one-half of a crank shaft rotation angle of 30°; a throttle position sensor 33, which detects an opening of the throttle valve 18; and an accelerator operated amount sensor 34, which detects the displacement of an accelerator pedal 34*a*.

Detection signals from the sensors 31, 32, 33 and 34 are transmitted to the ECU 3, which controls the engine 2 based on these detection signals. The ECU 3 is an arithmetic-logic circuit mainly comprising a CPU 3*a*, a ROM 3*b* and a RAM 3*c*. The ECU 3 is connected through a common bus 3*d* to an input port 3*e* and an output port 3*f* to exchange data with the outside. According to programs stored in the ROM 3*b*, the ECU 3 actuates the motor 19 and the ISCV 21 based on the detection signals transmitted from the intake pressure sensor 31, the rotation speed sensor 32, and the throttle position sensor 33, and executes feedback control in which the rotation speed of the engine 2 is controlled to coincide with a target rotation speed.

Now, a feedback control system will be explained.

Figure 3A:
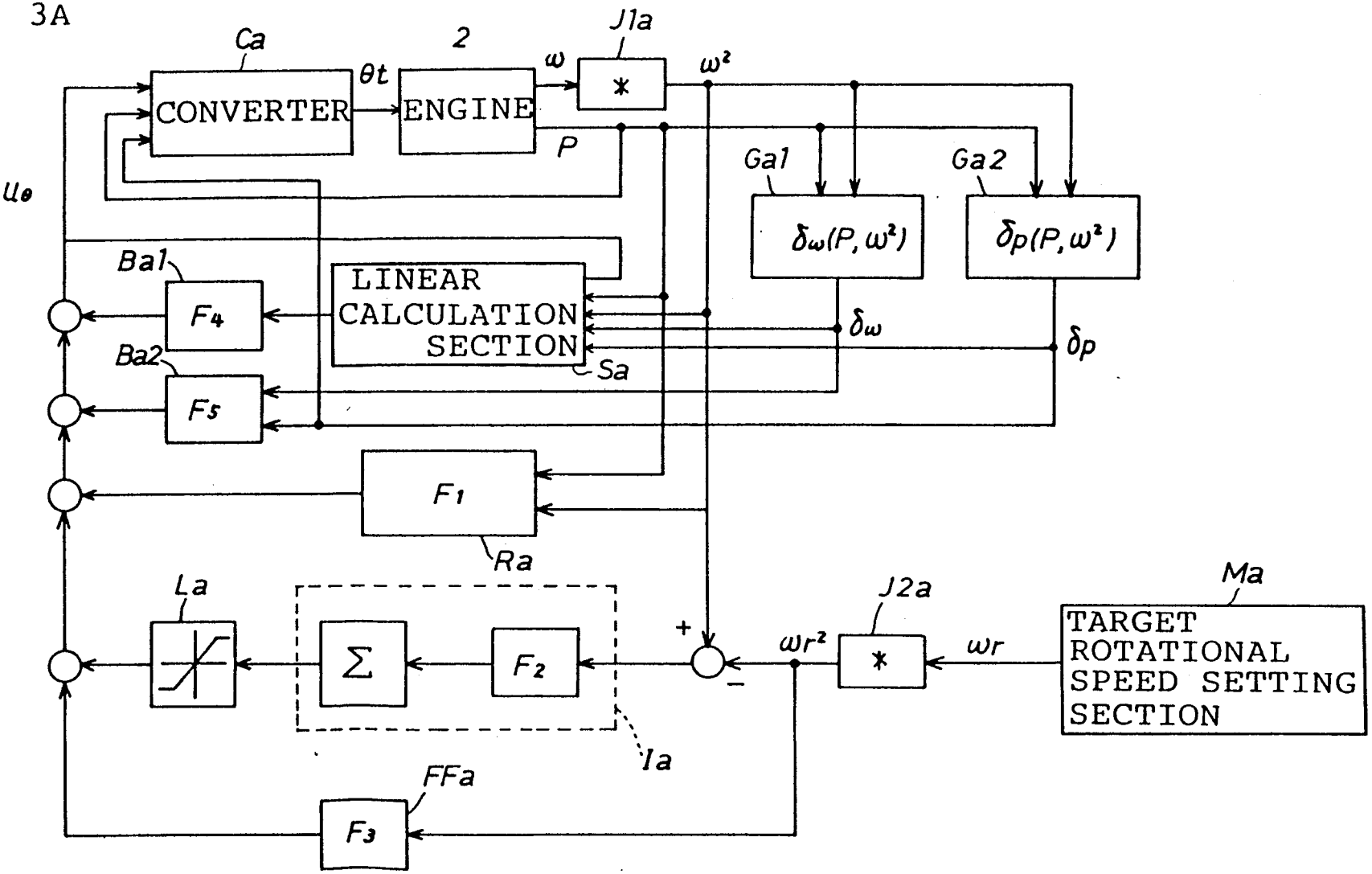
FIGS. 3A and 3B are block diagrams showing the control system for the embodiment.
Figure 3B:
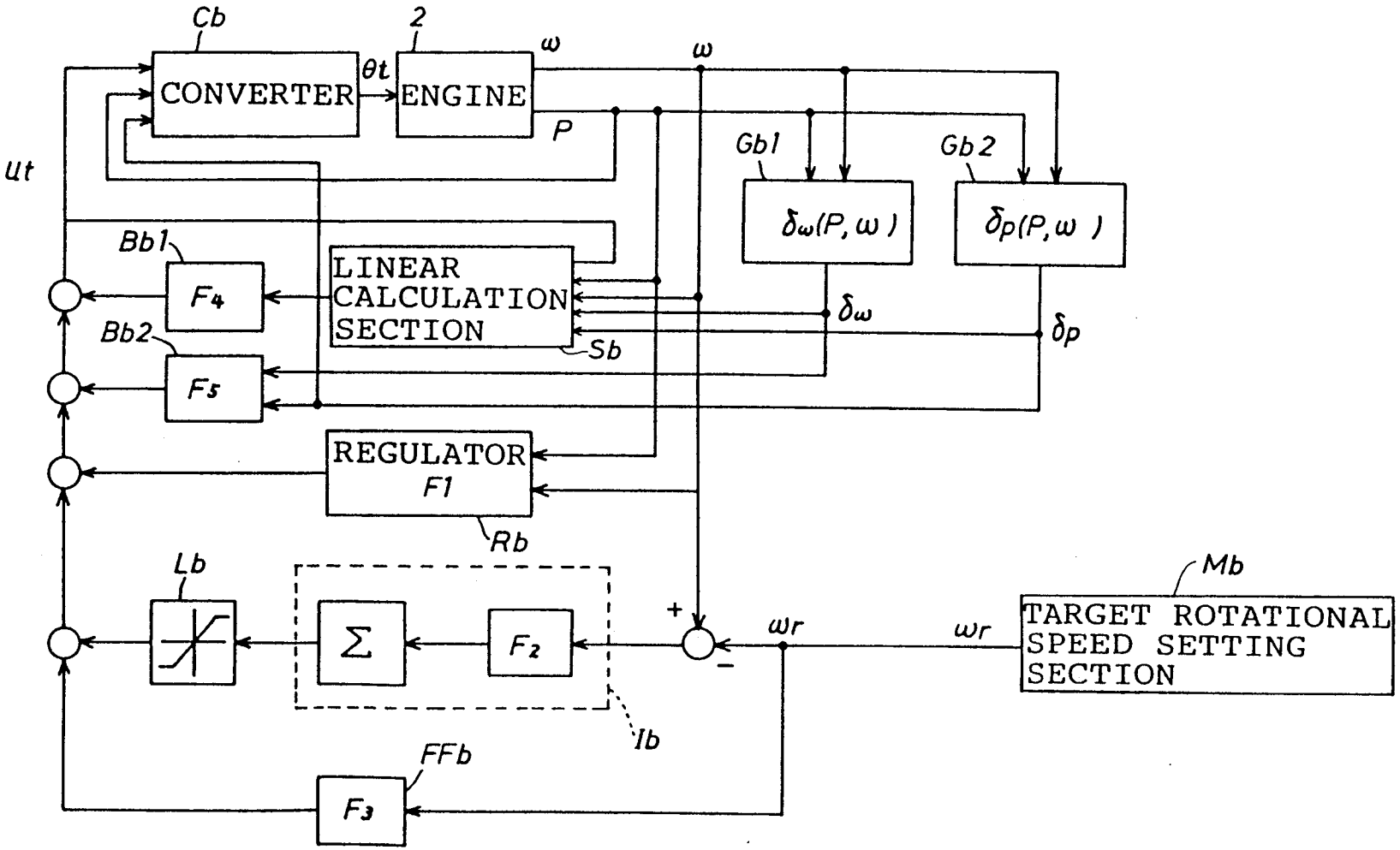

In this embodiment, the ECU 3 comprises a single feedback controller. However, as detailed later and as shown in FIGS. 3A and 3B, two kinds of the feedback control system that have the same control characteristics can be obtained. The feedback control systems in FIGS. 3A and 3B are distinguished from each other by adding suffix "a" or "b" to the symbols representing the elements of the control system.

Figure 6A:
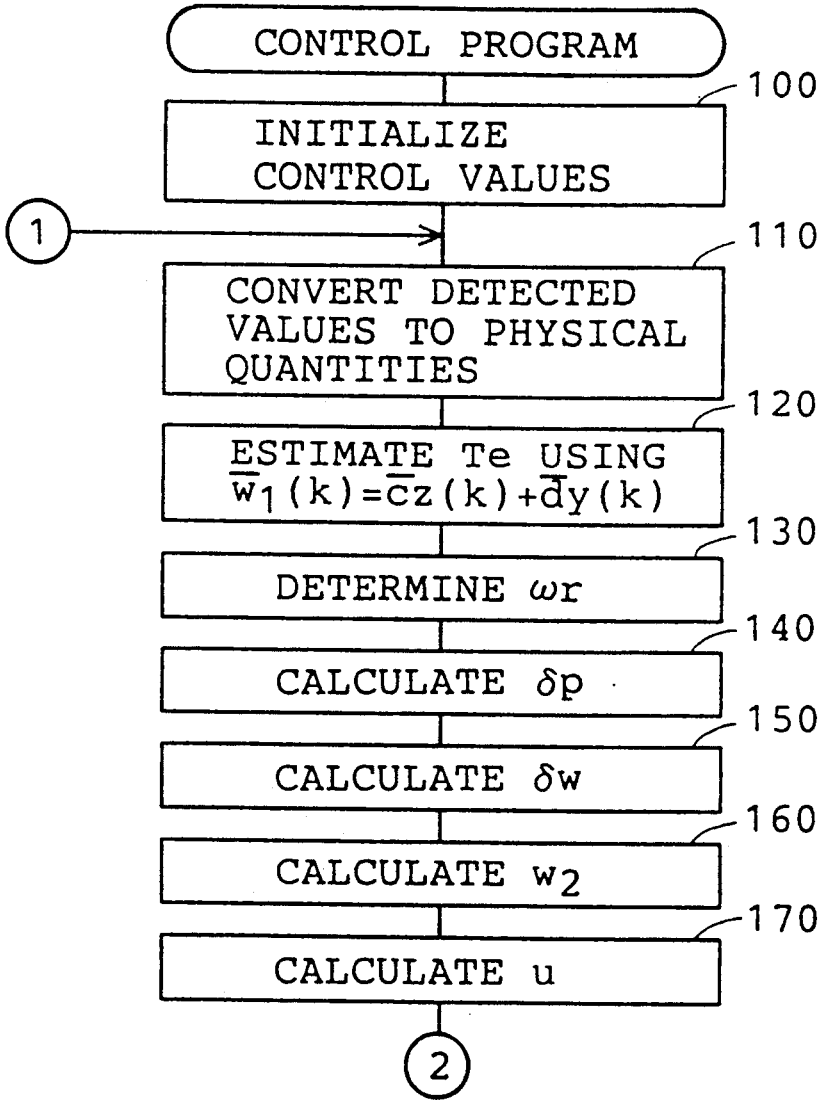
FIGS. 6A and 6B are flowcharts of a control program executed in the control system for the embodiment.
Figure 6B:
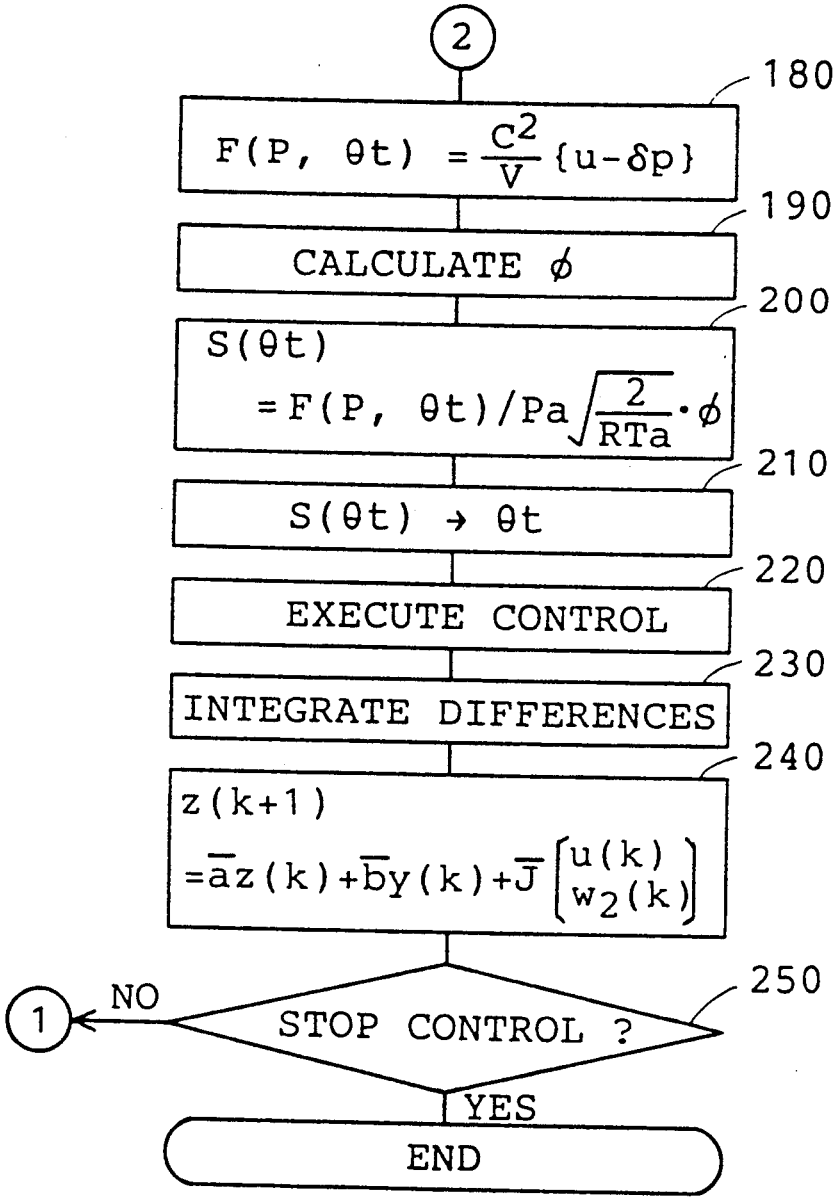

The control systems in FIGS. 3A and 3B are executed by the same aforementioned arithmetic-logic circuit, which mainly comprises the CPU 3*a*. The control systems shown in FIGS. 3A and 3B consist of discrete systems that are realized by executing a series of programs shown in the flowchart in FIGS. 6A and 6B. The control system shown in FIG. 3A is a discrete system based on the revolution speed of the engine 2. The control system shown in FIG. 3B is a discrete system based on the crank angle of the engine 2. As described later, in the control system of FIG. 3A a rotation speed squared $\omega^2$ calculated by a first multiplying section J1*a* and a target rotation speed squared $\omega r^2$ calculated by a second multiplying section J2*a* are used, while in the control system of FIG. 3B, an actual rotation speed of the engine 2 and a target rotation speed $\omega r$ are used.

As shown in FIGS. 3A and 3B, target rotation speed setting sections Ma and Mb set the target rotation speed $\omega r$, and the actual rotation speed $\omega$ of the engine 2 is controlled to coincide with the target rotation speed $\omega r$.

First, actual operating conditions of the engine 2 are detected by detecting the actual rotation speed $\omega$ and an intake pressure P. In the control system shown in FIG. 3A, the first multiplying section J1a calculates the rotation speed squared $\omega^2$ from the detected rotation speed $\omega$ of the engine 2. The rotation speed squared $\omega^2$ is transmitted together with the detected intake pressure P into disturbance compensators Ga1 and Ga2. In the control system shown in FIG. 3B, the detected rotation speed $\omega$ transmitted with the detected intake pressure P directly into the disturbance compensators Gb1 and Gb2.

The disturbance compensators Ga1 (Gb1) and Ga2 (Gb2) formulate disturbance values $\delta\omega$and $\delta p$ reflecting deviations between the actual engine 2 and an engine model. In FIG. 3A, functions $\delta\omega(P,\omega^2)$ and $\delta p(P,\omega^2)$ of the intake pressure P and the rotation speed squared $\omega^2$ are determined. In FIG. 3B, functions $\delta\omega(P,\omega)$ and $\delta p(P,\omega)$ of the intake pressure P and the rotation speed $\omega$ are determined. However, the disturbance values are not limited to these functions. Functions of detected values representing changes in the operating conditions of the engine 2, such as water temperature in the water jacket of the engine 2, intake air temperature and atmospheric pressure are also possible. The calculation method could be formulation of results of testing the engine 2, formulation of results of operating a simulated engine, or interpolation using established tables.

In FIG. 3A, (FIG. 3B), a linear calculation section Sa (Sb) estimates load torque Te of the engine 2 based on the rotation speed squared $\omega^2$ (the rotation speed $\omega$), the intake pressure P, the disturbance values $\delta\omega$ and $\delta p$ calculated by the disturbance compensators Ga1 (Gb1) and Ga2 (Gb2), and a variable $u_{\theta\,(ut)}$ (described later).

A regulator Ra (Rb) multiplies a determinant of the rotation speed squared $\omega^2$ (the rotation speed $\omega$) and the intake pressure P by an optimal feedback gain F1, and executes a feedback of the rotation speed squared $\omega^2$ (the rotation speed $\omega$) and the intake pressure P.

A second multiplying section J2a calculates the target rotation speed squared $\omega r^2$ from the tar et rotation speed $\omega r$. An integral compensator Ia (Ib) integrally compensates for unexpected disturbance by multiplying the deviation between the target rotation speed squared $\omega r^2$ (the target rotation speed $\omega r$) and the actual rotation speed squared $\omega^2$ (the actual rotation speed $\omega$) by an optimal feedback gain F2, and by accumulating the multiplied deviation sequentially.

A limiter La (Lb) determines upper-limit and lower-limit values for the values calculated by the integral compensator Ia (Ib). The limiter La (Lb) restricts the output value from the integral compensator Ia (Ib) to the range between the upper-limit and lower-limit values, and enhances the responsiveness of the feedback control system by preventing feedback values from overshooting and undershooting.

A feedforward controller FFa (FFb) determines a control input value by multiplying the target rotation speed squared $\omega r^2$ (the target rotation speed $\omega r$) to be controlled by a gain F3, and enhances the responsiveness of the control system.

Gain calculators Ba1 (Bb1) and Ba2 (Bb2) multiply the output values from the linear calculation section Sa (Sb) and the output values from the disturbance compensators Ga1 (Gb1) and Ga2 (Gb2) by optimal feedback gains F4 and F5, respectively.

The output values from the regulator Ra (Rb), the limiter La (Lb), the feedforward controller FFa (FFb) and the gain calculators Ba1 (Bb1) and Ba2 (Bb2) are added up to calculate the variable $u\theta$ ($u_t$). The variable $u\theta$ ($u_t$) is transmitted back to the linear calculation section Sa (Sb), and is also sent together with the disturbance value δp from the disturbance compensator Ga2 (Gb2) and the intake pressure P, into a converter Ca (Cb). The converter Ca (Cb) determines a throttle opening θt as a final control quantity.

The above discussion describes the hardware arrangement of the engine controller 1 and the arrangement of the control system that is realized by execution of programs (described later).

A dynamic physical model of the engine 2 for this embodiment is now described to explain the adequacy of the aforementioned construction of the engine controller 1, the calculation made by the linear calculation section Sa (Sb), and the calculation of the gains F1 through F5.

The behavior of the engine 2 is precisely expressed by equation (1) for motion of the engine 2 and equation (4) for mass conservation of the intake air.

$$M\cdot(d\omega/dt)=Ti-Te-Tf \quad (1)$$

In equation (1), M denotes the inertial moment of the rotating portion of the engine 2, and Te denotes the load torque of the engine 2. Ti denotes the output torque expected from the pressure in the cylinder of the engine 2. This torque Ti is expressed by the following equation (2):

$$Ti=\alpha_1\cdot P+\delta\omega P,\omega) \quad (2),$$ where $\alpha_1$ is a proportionality constant, and $\delta\omega(P,\omega)$ is a function of the intake pressure P and the rotation speed ω. By the function defined in this embodiment, the portion of the indicated torque Ti, which portion cannot be expressed as a function of the intake pressure P alone, is formulated as a deviation. The value of this deviation $\delta\omega(P,\omega)$ is determined by experiment.

In the above equation (1), Tf is a torque loss of the engine 2 and is shown in the following equation (3):

$$Tf=\alpha_2\cdot\omega^2+\alpha_3+\alpha_4\cdot(P-Pa) \quad (3),$$

where $\alpha_2$, $\alpha_3$, and $\alpha_4$ are proportionality constants, and Pa is an exhaust pressure. The first and second terms $(\alpha_2\cdot\omega^2+\alpha_3)$ on the right side of equation (3) represent a mechanical torque loss, and the third term $\alpha_4\cdot(P-Pa)$ on the right side of equation (3) represents the engine pumping pressure loss.

The following equation (4) for mass conservation of intake air also expresses the behavior of the engine 2 precisely.

$$(C^2/V)\cdot(dP/dt)=mt-mc \quad (4)$$

In the above equation (4), C denotes sonic velocity, V denotes an intake-air volume, mt denotes a mass flow of intake air passing through the throttle valve 18 per unit time, and mc denotes a mass flow of air passing through the cylinder 4a per unit time. The mass flows mt and mc are represented by the following equations (5) and (6) respectively:

$$mt=F(P,\theta t) \quad (5);$$

and $$mc=\alpha_5\cdot P\cdot\omega+\delta p\ (P,\omega) \quad (6),$$

where θt is a throttle opening, $F(P,\theta t)$ is an arbitrary function, $\alpha_5$ is a proportionality constant, and $\delta p(P,\omega)$ is the formulated difference of the portion of the mass flow mc that cannot be represented by $P\cdot\omega$.

In the same way as δω, $\delta p(P,\omega)$ is determined by experiments.

The following equation (7) is obtained by substituting equations (2) and (3) for equation (1), substituting equations (5) and (6) for equation (4), and solving these equations for the actual rotation speed ω and the intake pressure P.

$$\frac{d}{dt}\begin{vmatrix}\omega\\P\end{vmatrix}=\begin{vmatrix}0(\alpha_1+\alpha_4)/M\\0\quad 0\end{vmatrix}\begin{vmatrix}\omega\\P\end{vmatrix}+\begin{vmatrix}0\\V/C^2\end{vmatrix}F(P,\theta t)+\begin{vmatrix}1/M\\0\end{vmatrix}Te+\begin{vmatrix}(\delta\omega+\alpha_2\cdot\omega^2+\alpha_3-\alpha_4Pa)/M\\-(V/C^2)\cdot(\alpha_5\cdot P\cdot\omega-\delta p)\end{vmatrix} \quad (7)$$

When θ is a crank angle, the actual rotation speed of the engine 2 is represented by the equation: $\omega=d\theta/dt$.

Therefore, $$d\omega/dt = (d\omega/d\theta)\cdot(d\theta/dt) = (\tfrac{1}{2})\cdot(d\omega^2/d\theta)$$

Furthermore, $$dP/dt = (dP/d\theta)\cdot(d\theta/dt) = (dP/d\theta)\cdot\omega$$

The crank angle θ and the rotation speed ω have the relationship as shown in the above equations. By substituting these equations for equation (7), the following equation (8) is obtained:

$$\frac{d}{d\theta}\begin{vmatrix}\omega^2\\P\end{vmatrix}=\begin{vmatrix}2\cdot\alpha_2/M2(\alpha_1+\alpha_4)/M\\0\quad(V/C^2)\cdot\alpha_5\end{vmatrix}\begin{vmatrix}\omega^2\\P\end{vmatrix}+\begin{vmatrix}0\\V/C^2\end{vmatrix}\{F(P,\theta t)/\omega\}+\begin{vmatrix}2/M\\0\end{vmatrix}Te+\begin{vmatrix}2(\delta\omega+\alpha_3-\alpha_4Pa)/M\\(V/C^2)\cdot\delta p/\omega\end{vmatrix} \quad (8)$$

Furthermore, the following variables are defined by replacing the load torque Te with $w_1$.

$$u_t=(V/C^2)\{F(P,\theta t)-\alpha_5\cdot P\cdot\omega+\delta p\} \quad (9)$$

$$w_{2t}=\begin{vmatrix}2\cdot(\delta\omega+\alpha_2\cdot\omega^2+\alpha_3-\alpha_4Pa)/M\\(V/C^2)\cdot\delta p\end{vmatrix} \quad (10)$$

$$x_t=[\omega\ P]^t$$

$$A_t=\begin{vmatrix}0\quad 2(\alpha_1+\alpha_4)/M\\0\quad 0\end{vmatrix}$$

$$B_t=[0\ 1]^t,\ E_{t1}=[2/M\ 0]^t$$

$$E_{t2}=\begin{vmatrix}1\quad 0\\0\quad 1\end{vmatrix} \quad (11)$$

When equation (7) is modified using the above variables, equation (12) is established as follows:

$$x_t=A_tx_t+B_tu_t+E_{t1}w_1+E_{t2}w_{2t} \quad (12)$$

When xθ equals $[\omega^2P]^t$ and following equations (13) through (15) are established, equation (8) is modified to following equation (16):

$$u_\theta=(V/C^2)\{F(P,\theta t)/\omega+\delta p/\omega\} \quad (13)$$

-continued $$w_{2\theta} = \begin{vmatrix} 2 \cdot (\delta\omega + \alpha_3 - \alpha_4 Pa)/M \\ (V/C^2) \cdot \delta p \end{vmatrix} \quad (14)$$

$$A_\theta = \begin{vmatrix} 2 \cdot \alpha_2/M2(\alpha_1 + \alpha_4)/M \\ 0 \quad V \cdot \alpha_5/C^2 \end{vmatrix}$$

$$B_\theta = [0\ 1]^t,\ E_{\theta 1} = [2/M\ 0]^t$$

$$E_{\theta 2} = \begin{vmatrix} 1 & 0 \\ 0 & 1 \end{vmatrix} \quad (15)$$

$$x_\theta = A_\theta \cdot x_\theta + B_\theta \cdot u_\theta + E_{\theta 1} \cdot w_1 + E_{\theta 2} \cdot w_{2\theta} \quad (16)$$

In equation (16), x denotes a differential for the crank angle $\theta$.

The equations (12) and (16) can be modified in the same form, and the following equation (17) is established:

$$x = A \cdot + B \cdot u + E_1 w_1 + E_2 \cdot w_2 \quad (17)$$

Since the equations (12) and (16) are expressed using this same form, discussion will be based on the equation (17). The results of the discussion can be applied to differentials of time and crank angle. As mentioned, two types of the control system having the same control characteristics are constructed as shown in FIGS. 3A and 3B. In FIG. 3A, the rotation speed squared $\omega^2$ is used as a variable for control, and in FIG. 3B, the actual rotation speed $\omega$ is used as the variable.

Using equation (17), the control system for controlling the actual rotation speed $\omega$ of the engine 2 to coincide with the target rotation speed $\omega r$ is explained. If output value y equals $\omega$ or $\omega^2$, its target value yr equals $\omega r$ or $\omega r^2$, and C=[1 0], the following output equation (18) can be established:

$$y = Cx \quad (18)$$

Equations (17) and (18) are made discrete to form the following equations (19) and (20):

$$x(k+1) = \Phi \cdot x(k) + \Gamma \cdot u(K) + \pi_1 w_1(K) + {}_2 \cdot w_2(K) \quad (19)$$

$$y(k) = \Theta \cdot x(k),\ \Theta = C \quad (20)$$

When a control cycle is $\Delta T$, the following are primary approximations for $\Delta T$:

$$\Phi \approx I + \Delta T \cdot A,\ \Gamma \approx \Delta T \cdot B$$

$$\pi_1 \approx \Delta T \cdot E_1,\ \pi_2 \approx \Delta T \cdot E_2$$

In these equations, I denotes an identity matrix.

The following more precise values can be used in the equation (19):

$$\Phi = e^{A\Delta T},\ \Gamma = \int_0^{\Delta T} e^{A\tau} \cdot d\tau \cdot B$$

$$\pi_1 = \int_0^{\Delta T} e^{A\tau} \cdot d\tau \cdot E_1$$

-continued $$\pi_2 = \int_0^{\Delta T} e^{A\tau} \cdot d\tau \cdot E_2 \quad (22)$$

$$w_1(k+1) = w_1(k) \quad (23)$$

If the load torque Te and $w_1$ change in a stepwise manner in equation (19), and if equation (23) is used, an augmented system, as shown in the following equations (24) and (25), is introduced.

$$\begin{vmatrix} x(k+1) \\ w1(k+1) \end{vmatrix} = \begin{vmatrix} \Phi\pi_1 \\ 0\ I \end{vmatrix} \begin{vmatrix} x(k) \\ w_1(k) \end{vmatrix} + \begin{vmatrix} \Gamma\pi_2 \\ 0\ 0 \end{vmatrix} \begin{vmatrix} u(k) \\ w_2(k) \end{vmatrix} \quad (24)$$

$$y(k) = [0\ 0] \begin{vmatrix} x(k) \\ w_1(k) \end{vmatrix} \quad (25)$$

Minimum order observer of the augmented system shown in equations (24) and (25) are as follows:

$$z(k+1) = az(k) + by(k) + J \begin{vmatrix} u(k) \\ w_2(k) \end{vmatrix} \quad (26)$$

$$w_1(k) = cz(k) + dy(k) \quad (27)$$

where z is a quantity of internal state, and $w_1$ is an estimated value of $w_1$.

Equation (27) is the last row of the following equation (28).

$$\begin{vmatrix} x(k) \\ w_1(k) \end{vmatrix} = Cz(k) + Dy(k) \quad (28)$$

From equation (27), the estimated value $w_1$ of the load torque Te can be obtained.

Now, the $\omega r$ follow-up control is explained.

If an unexpected disturbance $w_3$ is found at the right side of equation (19), the following equation (29) is obtained.

$$x(k+1) = \Phi \cdot x(k) + \Gamma \cdot u(k) + \pi_2 \cdot w_2(k) + \pi_1 \cdot w_1(k) + w_3 \quad (29)$$

If $w_3=0$, y=yr, and u=ur, then the following equations (30) and (31) are established.

$$xr(k+1) = \Phi \cdot xr(k) + \Gamma \cdot ur(k) + \pi_1 \cdot w_1(k) + \pi_2 \cdot w_2(k) \quad (30)$$

$$yr(k) = \Theta \cdot xr(k) \quad (31)$$

From the combination of equations (29) and (30), and from that of equations (20) and (31), the following equations (32) and (33) are derived.

$$[x(k+1) - xr(k+1)] = \Phi\ [x(k) - xr(k)] + \Gamma\ [u(k-) - ur(k)] + w_3 \quad (32)$$

$$[y(k) - yr(k)] = \Theta \cdot [x(k) - xr(k)] \quad (33)$$

By using the definitions as shown in equations (34) through (36), equations (32) and (33) are arranged as shown in the following equations (37) and (38).

$$X(k) \equiv x(k) - xr(k) \quad (34)$$

$$U(k) \equiv u(k) - ur(k) \quad (35)$$

$$Y(k) \equiv y(k) - yr(k) \quad (36)$$

$$X(k+1) = \Phi \cdot X(k) + \Gamma \cdot U(k) + w_3 \quad (37)$$

$$Y(k)=\Theta\cdot X(k) \tag{38}$$

If a difference operator $\Delta$ is used, and $w_3$ changes in a stepwise manner, the following equation (39) is derived. Equations (37) and (38) are then modified to the following equations (40) and (41).

$$\Delta w_3=0 \tag{39}$$

$$X(k+1)=\Phi\cdot\Delta X(k)+\Gamma\cdot\Delta U(k) \tag{40}$$

$$Y(k)=Y(k-1)+\Theta\cdot\Delta X(k) \tag{41}$$

Consequently, from equations (40) and (41), the augmented system expressed by the following equation (42) can be obtained:

$$\begin{vmatrix} \Delta X(k+1) \\ Y(k) \end{vmatrix} = \begin{vmatrix} \Phi & 0 \\ \Theta & I \end{vmatrix} \begin{vmatrix} \Delta X(k) \\ Y(K-1) \end{vmatrix} + \begin{vmatrix} \Gamma \\ 0 \end{vmatrix} \cdot \Delta U(k) \tag{42}$$

If Q is a semi-definite matrix and R is a definite matrix, the discrete criterion function J for equation (42) is expressed as follows:

$$J = \sum_{k=1}^{\infty} \left\{ \left\| \begin{vmatrix} \Delta X(k) \\ Y(k-1) \end{vmatrix} \right\|^2 Q + ||\Delta U(k)||^2 R \right\} \tag{43}$$

By solving the discrete Riccati equation, $\Delta U(k)$ having J as its minimum value can be obtained as follows:

$$\Delta U(k) = F \begin{vmatrix} \Delta X(k) \\ Y(k-1) \end{vmatrix} \tag{44}$$

If F in equation (44) is expressed as shown in the following equation (45), the following equation (46) can be obtained:

$$F = [F1\ F2] \tag{45}$$

$$U(k) = F_1X(k) + \sum_{i=0}^{k-1} F_2Y(i) \tag{46}$$

By substituting equations (34), (35) and (36) for equation (46), the following equation (47) is obtained.

$$u(k) = F_1x(k) + \sum_{i=0}^{k-1} F_2\{y(i) - yr(i)\} + (ur(k) - F_1xr(k)) \tag{47}$$

On the other hand, equations (30) and (31) are arranged as follows:

$$xr(k+1) \approx xr(k) \tag{48}$$

The following equations (49) and (50) are then established.

$$[I-\Phi]xr(k)+\Gamma\cdot u(k)=\pi_1\cdot w_1(k)+\pi_2\, w_2 2(k) \tag{49}$$

$$\Theta\cdot xr(k)=yr(k) \tag{50}$$

Subsequently, the following equation (51) can be established:

$$\begin{vmatrix} I-\Phi & \Gamma \\ \Theta & 0 \end{vmatrix} \begin{vmatrix} xr(k) \\ ur(k) \end{vmatrix} = \begin{vmatrix} \pi_1 w_1(k) + \pi_2 w_2 \\ yr(k) \end{vmatrix} \tag{51}$$

As seen in the above equation (51), if constant matrices $F_3$, $F_4$ and $F_5$ are used, the third term at the right side of the equation (47) is expressed as follows:

$$ur(k)-F_1xr(k)=F_3yr(k)+F_4w_1(k)+F_5w_2(k) \tag{52}$$

Consequently, the equation (47) can be expressed as follows:

$$u(k) = F_1x(k) + \sum_{i=0}^{k-1} F_2\{y(i) - yr(i)\} + F_3yr(k) + F_4w_1(k) + F_5w_2(k) \tag{53}$$

By replacing x(k) and $w_1(k)$ in equation (53) with $\bar{x}k)$ and $\bar{w}_1(k)$ calculated from the equation (28), a final control law can be obtained as follows:

$$u(k) = F_1x(k) + \sum_{i=0}^{k-1} F_2\{y(i) - yr(i)\} + F_3yr(k) + F_4w_1(k) + F_5w_2(k) \tag{54}$$

The variable u(k) calculated using equation (54) corresponds to the variable $u_t$ defined by equation (9) and the variable $u\theta$ defined by the equation (13). The variable u(k) should be converted to the throttle opening $\theta t$ as the final control quantity. The throttle opening $\theta t$ can be easily obtained by solving either of the following equations (55) and (56).

$$F(P, \theta t) = (C^2/V)\cdot u_t + \alpha_5 \cdot P\cdot\omega - \delta p \tag{55}$$

$$F(P, \theta t) = \omega\{(C^2/V)\cdot u\theta - \delta p\} \tag{56}$$

The throttle opening $\theta t$ and the mass flow mt of the intake air passing through the throttle valve 18 per unit time have the following relationship:

$$\begin{aligned} mt &= S(\theta t)\cdot Patm\cdot\{2/(R\cdot Tatm)\}^{\frac{1}{2}}\cdot\phi \\ &= F(P, \theta t) \end{aligned} \tag{57}$$

where

Tatm is the temperature of the intake air (i.e. the temperature of an air cleaner), $S(\theta t)$ is an effective throttle opening area with regard to the throttle opening $\theta t$ Patm is atmospheric pressure, and R is a gas constant.

Figure 4:
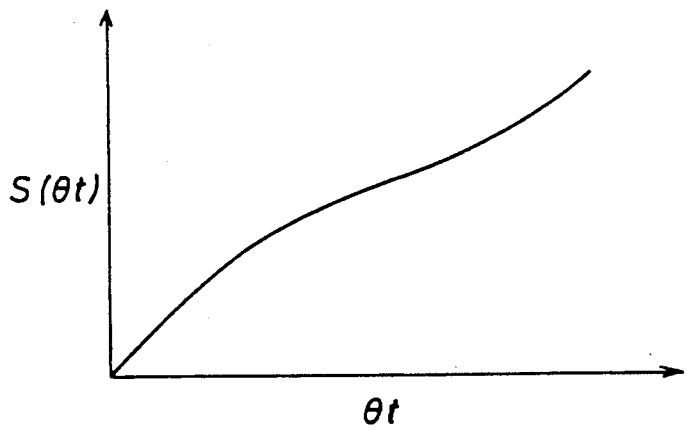
FIG. 4 is a graph showing the relationship between a throttle opening $\theta t$ and an effective throttle opening area $S(\theta t)$.

Since throttle valves have a complicated configuration, it is difficult to theoretically obtain the throttle effective opening area from a structural constant. However, by obtaining only the throttle opening $\theta t$, the throttle effective opening area can be precisely obtained. The throttle effective opening area can be experimentally obtained from the intake air continuously flowing through the throttle valve 18. As a result of experiments on the engine 2 for this embodiment, $S(\theta t)$ and $\theta t$ have been found to have the relationship as shown in FIG. 4.

In equation (57), $\phi$ is a function of a ratio (P/Pa) between the intake pressure P and the discharged-air pressure Patm. The value of $\phi$ is obtained as follows:

1. For high-level throttle opening:

$$P/Patm > \{2/(d+1)\}d/(d-1)$$

In the equations, d is a specific heat ratio of the intake air.

$$\phi = [\{(d/(d-1)\}\{PM_k/Patm_k)^{2/d} - (PM_k - Patm_k)(d+1)/6\}]^{\frac{1}{2}} \quad (58)$$

2. For low-level throttle opening:

$$P/Patm \leqq \{2/(d+1)\}d/(d+1)$$

$$\phi = \{(2/(d+1)1/(d-1)\cdot\{2d/(d+1)\}\}^{\frac{1}{2}} \quad (59)$$

Figure 5:
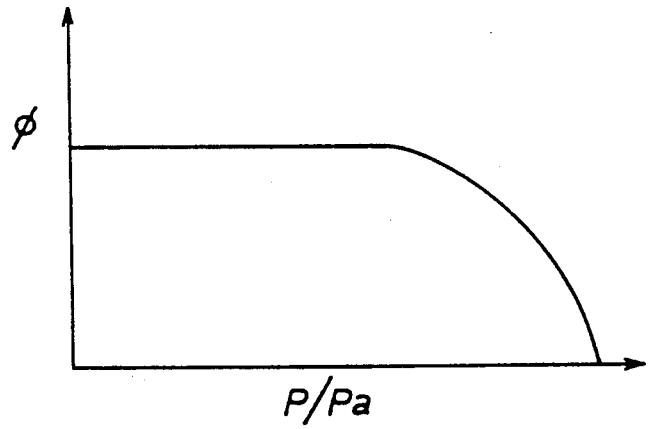
FIG. 5 is a graph showing the relationship between a coefficient $\phi$ for calculating a mass flow mt of the intake air and a ratio P/Patm of intake pressure P and atmospheric pressure Patm.

FIG. 5 shows the results of experiments for obtaining the relationship between the function $\phi$ and the ratio (P/Patm).

When the effective throttle opening area $S(\theta t)$ and the throttle opening $\theta t$ have the relationship as shown in FIG. 4, and the function $\phi$ and the ratio (P/Patm) have the relationship as shown in FIG. 5, the mass flow mt can be precisely obtained by detecting the intake pressure P, the atmospheric pressure Patm, and the throttle opening $\theta t$.

Consequently, the throttle opening $\theta t$ can be easily obtained from the mass flow mt, the intake pressure P, and the atmospheric pressure Patm.

The above discussion shows that the block diagrams in FIGS. 3A and 3B are valid. Specifically, the disturbance values $\delta\omega$and $\delta p$ calculated by the disturbance compensators Ga1, Ga2, Gb1 and Gb2 shown in FIGS. 3A and 3B correspond to $\delta\omega$and $\delta p$ in the equation (8), and the linear calculation sections Sa and Sb make calculations as shown in the equations (26) and (27).

The first term on the right side of the equation (47) corresponds to the function of the regulators Ra and Rb. The second term on the right side of the equation (47) refers to the function of the integral compensators Ia and Ib.

The converters Ca and Cb calculate the throttle opening $\theta t$, the actual control quantity, from the variables $u^{\theta}$ and ut, respectively, as illustrated in the tables corresponding in FIGS. 4 and 5, and in equations (55) or (56).

The coefficients $F_1$ through $F_5$ by which the terms in equation (54) are multiplied correspond to the feedback gains $F_1$ through $F_5$ shown in FIGS. 3A and 3B. The coefficients $F_1$ through $F_5$ in FIG. 3A differ in their value from those in FIG. 3B.

The aforementioned discrete control system is executed by the ECU 3. The engine control program will be explained next with reference to the flowchart in FIGS. 6A and 6B. The program is stored in ROM 3*b*. When the engine 2 is started, the CPU 3*a* begins and repeats this engine control program.

First, step 100 initializes control values. For example, an initial value is set in the integral compensators Ia and Ib, and an initial value for the internal state quantity z is set so that the linear calculation sections Sa and Sb can make calculations. Subsequently, step 110 receives the values detected by the intake pressure sensor 31, the rotation speed sensor 32 and the other sensors for detecting the current operating state of the engine 2, and converts the detected values into the physical quantities required for the execution of control. For example, the actual rotation speed $\omega$ of the engine 2 is detected, or the rotation speed squared $\omega^2$ is calculated from the rotation speed $\omega$.

Figure 7:
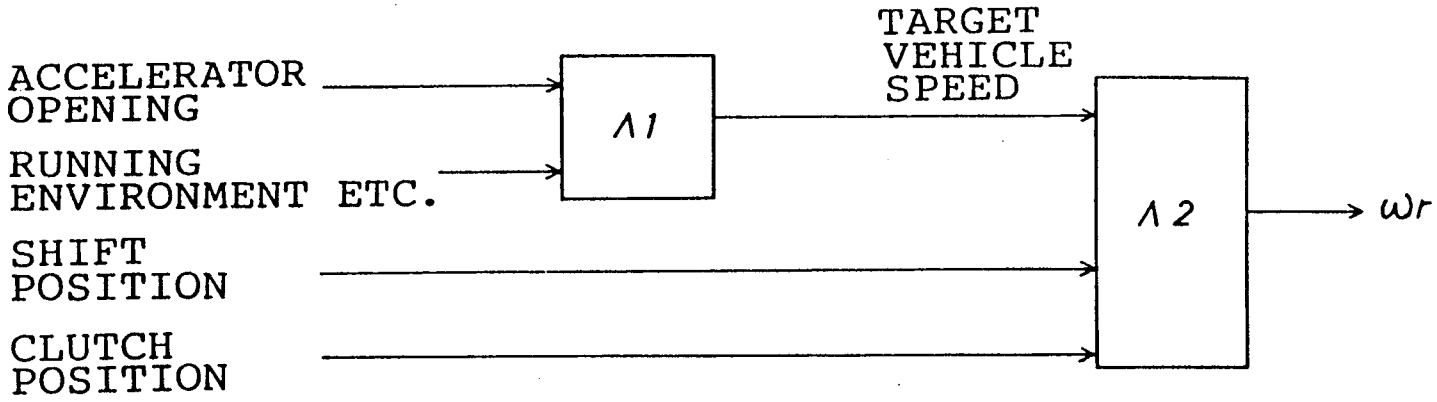
FIG. 7 is a block diagram showing the method for determining a target rotation speed $\omega r$.

After preparations for the control system are completed at steps 100 and 110, step 120 estimates the load torque Te by making a static calculation of equation (27). Subsequently, step 130 determines the target rotation speed $\omega r$ of the engine 2. As shown in FIG. 7, the target rotation speed $\omega r$ is determined by a system where a converter 1 calculates a vehicle target speed from an accelerator opening and the running environment of the engine 2, and a converter 2 receives information such as the vehicle target speed calculated by the converter 1, and a shift position and a clutch position of a transmission connected to the engine 2. The converter 2 thus determines the target rotation speed $\omega r$. The system for determining the target rotation speed $\omega r$ can be separate from the program shown in FIGS. 6A and 6B, or the system can be part of the processing at step 130. The structure of the system is determined by the capacity of the ECU 3.

Steps 140 and 150 calculate the disturbance values $\delta p$ and $\delta\omega$ in equations (7) and (8), respectively, by searching a table for $\delta p$ and $\delta\omega$. The table for detecting the disturbance values is stored beforehand in the ROM 3*b*, based on the operating state of the engine 2 detected in step 110. Step 160 calculates the variable $w_{2t}$ or $w_{2\theta}$. The variables are defined by the equations (10) and (14).

In the aforementioned steps, the load torque $Te(=w_1)$, the target rotation speed $\omega r$, and the rotation speed squared $\omega r^2$ are calculated. Subsequently, step 170 calculates the variable u(k), i.e., $u_t$ and $u_\theta$ using the equation (47).

Subsequently, step 180 calculates the function $F(P, \theta t)$ using the equations (55) and (56). Step 190 calculates the function $\phi$ from the intake-air pressure P and the discharged-air pressure Pa, using the characteristic graph in FIG. 5. Step 200 calculates the effective throttle opening area $S(\theta t)$ using these functions $F(P, \theta t)$ and $\phi$ according to the equation (57). At step 210, the effective throttle opening area $S(\theta t)$ is converted to the throttle opening $\theta t$, the control quantity, using the graph in FIG. 4.

After the throttle opening $\theta t$ is obtained, step 220 executes control by transmitting the throttle opening $\theta t$ to the output section 3*f* of the ECU 3, and by actuating the motor 19.

Subsequently, step 230 integrates the differences between control target values and actual values according to the following equation (60) which corresponds to the second term of equation (54):

$$Se = Se + F_2\{yi - yr(i)\} \quad (60)$$

Step 240 calculates the quantity z of the internal state using equation (26). One cycle of the discrete control is thus completed.

Subsequently, at step 250, it is determined whether the engine 2 has been stopped by a key switch (not shown) and control need not be continued. If it is determined that further control is required, the process goes back to step 110, repeating the control. If the conditions for stopping the control exist, the process ends.

The above-described arrangement of the control system for this embodiment provides the following advantage.

When the model of the engine 2 is constructed, the deviations of the actual engine from the engine model can be minimized by using the measurable control quantities representing the internal state of the engine 2. The deviations that cannot be measured are incorporated as the disturbance values $\delta p$ and $\delta\omega$ into the control system to enhance the precision of the engine model.

Consequently, optimal control values are used for the feedback control, thus enhancing the precision of the control. The actual rotation speed can be stably controlled and can quickly converge to the target rotation speed $\omega r$.

In this embodiment, if the variables cannot be measured or calculated, the possible approximate values of the variables are estimated from the tables in FIGS. 4 and 5. A good level of control precision can thus be secured, even when the operating state of the engine 2 varies widely.

Furthermore, the load torque Te, which is physically significant, is estimated for this embodiment as a variable representing the internal state of the engine 2. The estimated value of the load torque Te can also be used for the other control systems such as an ignition timing control system and a fuel injection volume control system. The control apparatus for the embodiment can thus be used effectively.

This is only one possible embodiment of the invention claimed below. This embodiment is only an illustration of the claims, and in no way restricts the scope of the claims.

What is claimed is:

1. A nonlinear feedback control method for an internal combustion engine comprising the steps of:

preparing a model of the behavior of the engine by formulating a motion equation representing the fluctuating motion of the engine, including a load torque portion that is an unmeasurable state of the engine, and formulating the mass conservation equation representing fluctuations in an intake air pressure of the engine for a predetermined time, including a mass flow portion that is an unmeasurable state of the engine;

detecting a measurable state of the engine;

determining deviations that are unmeasurable factors between the actual engine operation and the modeled behavior of the engine according to the measurable states of the engine;

incorporating the deviations into the motion equation and the mass conservation equation;

estimating the load torque by developing the simultaneous equations of the motion equation and the mass conservation equation for an augmented system; and executing optimum feedback control based on the measurable operating states of the engine, the formulated deviations, and the estimated load torque.

2. A nonlinear feedback control method for an internal combustion engine according to claim 1, in which the behavior of the engine is modeled by the following motion equation of the engine:

$$M\cdot(d\omega/dt)=Ti-Te-Tf,$$

where M denotes an inertial moment of the rotating portion the engine, $(d\omega/dt)$ denotes rotational speed of the engine, Te denotes load torque of the engine, Ti denotes an output torque calculated from the pressure in a cylinder of the engine, and Tf is a torque loss of the engine.

3. A nonlinear feedback control method for an internal combustion engine according to claim 2, in which the output torque Ti and torque loss Tf are expressed by the following equation:

$$Ti=\alpha_1\cdot P+\delta\omega(P,\omega),$$

where $\alpha_1$ is a proportionally constant, and $\delta\omega(P,\omega)$ is a function of intake air pressure P and rotation speed $\omega$ that represents the portion of the indicated torque Ti that cannot be expressed as a function of the intake pressure P alone, formulated as a deviation; and $$Tf=\alpha_2\cdot\omega^2+\alpha_3+\alpha_4\cdot(P-Pa),$$

where $\alpha\alpha_2$, $\alpha_3$ and $\alpha_4$ are proportionality constants, and Pa is exhaust pressure, the first and second terms $(\alpha_2\cdot\omega^2+\alpha_3)$ represent a mechanical torque loss, and the third term $\alpha_4\cdot(P-Pa)$ represents the engine pumping pressure loss.

4. A nonlinear feedback control method for an internal combustion engine according to claim 1, in which the mass conservation equation of intake air is expressed by the following equation:

$$(C^2/V)\cdot(dP/dt)=mt-mc,$$

where C denotes sonic velocity, V denotes an intake air volume, dP/dt denotes rate of change of intake air pressure P, mt denotes mass flow of intake air passing through the throttle valve per unit time, and mc denotes mass flow of air passing through a cylinder per unit time.

5. A nonlinear feedback control method for an internal combustion engine according to claim 4, in which mass flow mt of intake air passing through the throttle valve per unit time and the mass flow mc passing through a cylinder per unit time are represented by the following equations:

$$mt=F(P,\theta t);\text{ and}$$

$$mc=\alpha_5\cdot P\cdot\omega+\delta p(P,w),$$

where $\theta t$ is a throttle opening, $F(P,\theta T)$ is an arbitrary function, and $\delta p(P,\omega)$ is a formulated difference of the portion of the mass flow mc that cannot be represented by $p\cdot\omega$, and where $\delta p(P,w)$ is determined from experiments.

6. A nonlinear feedback control method for an internal combustion according to claim 1, in which the step of determining deviations comprises determining by experiment the relationship between the deviations and the measurable state of the engine.

7. A nonlinear feedback control method for an internal combustion engine according to claim 1, in which the step of executing the optimum feedback control comprises determining the throttle opening $\theta t$.

8. A nonlinear feedback control method for an internal combustion engine according to claim 7, in which the throttle opening $\theta t$ and the mass flow mt of the intake air passing through the throttle valve per unit time have the following relationship:

$$\begin{aligned} mt &= S(\theta t)\cdot Patm\cdot\{2/(R\cdot Tatm)\}^{\frac{1}{2}}\cdot\phi \\ &= F(P,\theta t) \end{aligned}$$

where Tatm is a temperature of the intake air, $S(\theta t)$ is an effective throttle opening area with regard to the throttle opening $\theta t$, Patm is atmospheric pressure, and R is a gas constant, and where $S(\theta t)$ and $\theta t$ have an experimentally determined relationship.

9. A nonlinear feedback control method for an internal combustion engine comprising the steps of:

preparing a model of the behavior of the engine by formulating a motion equation representing the fluctuating motion of the engine, including a load torque portion that is an unmeasurable state of the engine, and formulating a mass conservation equation representing fluctuations in an intake air pressure of the engine for a predetermined time, including a mass flow portion that is an unmeasurable state of the engine;

detecting an intake pressure of intake air and an engine speed;

determining torque deviations of the output torque of the engine and mass flow deviations of intake air passing through the throttle valve between the actual engine operation and the modeled behavior of the engine according to the intake pressure of intake air and the engine speed;

incorporating the deviations into the motion equation and the mass conservation equation;

estimating the load torque by developing the simultaneous equations of the motion equation and the mass conservation equation for an augmented system; and executing an optimum feedback control based on the intake pressure of intake air, the engine speed, the formulated deviations, and the estimated load torque.

10. A nonlinear feedback control method for an internal combustion engine comprising the steps of:

detecting intake pressure of intake air and engine speed;

preparing a model of the behavior of the engine by formulating a motion equation representing the fluctuating motion of the engine, including a load torque portion that is an unmeasurable state of the engine, and formulating the mass conservation equation representing fluctuations in an intake air pressure of the engine for a predetermined time, including a mass flow portion that is an unmeasurable state of the engine;

estimating the load torque by developing the simultaneous equations of the motion equation and the mass conservation equation for an augmented system;

determining a desired engine speed according to vehicle running conditions;

determining disturbance values $\delta p$ and $\delta\omega$ according to the intake air pressure and the engine speed:

determining variables ut and $u\theta t$ based on the estimated load torque, the desired engine speed, and the disturbance values $\delta p$ and $\delta\omega$ in order to adjust the engine speed toward the desired engine speed; and converting the variables ut and $u\theta t$ into a control amount for the throttle opening $\theta t$.

11. A nonlinear feedback control method for an internal combustion engine according to claim 10, in which the step of converting the variables ut and $u\theta t$ comprises the steps of:

determining a function $\phi$ from the intake air pressure P and the atmospheric pressure Patm;

determining an effective throttle opening area $S(\theta t)$ according to an experimentally determined relationship between mass flow of intake air passing through the throttle valve per unit time $F(P,\theta t)$, the atmospheric pressure Patm, an intake air pressure temperature Tatm, and the function $\phi$;

determining a throttle opening $\theta t$ according to an experimentally determined relationship between the throttle opening $\theta t$ and the effective throttle opening area $S(\theta t)$; and controlling an actuator of the throttle valve according to the throttle opening $\theta t$.

12. A nonlinear feedback control apparatus for an internal combustion engine comprising:

modeling means for modeling behavior of the engine by formulating a motion equation representing the fluctuating motion of the engine, including a load torque portion that is an unmeasurable state of the engine, and formulating the mass conservation equation representing fluctuations in an intake air pressure of the engine for a predetermined time, including a mass flow portion that is an unmeasurable state of the engine; detecting measurable states of the engine and determining deviations that are unmeasurable factors between the actual engine operation and the modeled behavior of the engine according to the measurable states of the engine; and incorporating the deviations into the motion equation and the mass conservation equation;

observing means for estimating the load torque by developing the simultaneous equations of the motion equation and the mass conservation equation for an augmented system;

control means for executing optimum feedback control based on the measurable operating states of the engine, the formulated deviations, and the estimated load torque.

* * * * *